United States Patent [19]

Anderson et al.

[11] 3,953,742

[45] Apr. 27, 1976

[54] CATHODIC PROTECTION MONITORING APPARATUS FOR MARINE PROPULSION DEVICE

[75] Inventors: Edward P. Anderson, Fond du Lac; Mark Harris, Brownsville, both of Wis.

[73] Assignee: Brunswick Corporation, Skokie, Ill.

[22] Filed: July 17, 1974

[21] Appl. No.: 489,147

[52] U.S. Cl. ..... 307/95; 204/196

[51] Int. Cl.[2] ..... H01B 7/28

[58] Field of Search ..... 307/95; 204/196, 195 C, 204/147; 340/249

[56] References Cited

UNITED STATES PATENTS

| | | | |
|---|---|---|---|
| 3,242,064 | 3/1966 | Byrne | 204/196 |
| 3,327,214 | 6/1967 | Allen et al. | 324/29 |

*Primary Examiner*—David Smith, Jr.

*Attorney, Agent, or Firm*—Andrus, Sceales, Starke & Sawall

[57] ABSTRACT

A cathodic protection system monitor is coupled to an impressed current cathodic protection circuit used for corrosion protection of a submerged marine drive. The cathodic protection circuit includes one or more anodes and a reference electrode mounted below the water line and connected to an automatic controller for supplying an anode current which is regulated in order to maintain a predetermined reference potential on the protected structure. A switch selectively connects a light emitting diode (LED) lamp or other light source between the controller output and ground so that the controller current may, when tested, be used to operate the light source in order to confirm that power is available to the anode.

16 Claims, 3 Drawing Figures

CATHODIC PROTECTION MONITORING APPARATUS FOR MARINE PROPULSION DEVICE

BACKGROUND OF THE INVENTION

The present invention relates to an impressed current cathodic protection monitoring system for marine apparatus and particularly to equipment for monitoring an impressed current automatically controlled cathodic protection system for protecting underwater metal such as marine outboard motors, stern drive propulsion units and the like.

Underwater metallic structures of marine propulsion devices are subject to damaging corrosion particularly when the marine apparatus is employed in salt water and other water environments. Outboard motors and the stern drive component of an inboard-outboard marine propulsion unit are secured to the aft end or transom of the boat with a pendant propeller propulsion means which extends downwardly from the transom below the water line. Such propeller units are metal and generally consist of aluminum and steel. Generally, other metals will be associated with the lower unit. In such practical constructions, the lower submergible unit is highly subject to corrosive action as a result of the galvanic potential difference between the metal components. The problem is particularly severe in salt water environments. It is well-known that current produced by a sacrificial anode or direct current (D.C.) impressed on a permanent anode can be mounted to the transom below the water level to create a protective polarization of the lower unit (the cathode) to retard such corrosive action. The D.C. power sources must have the positive side coupled to the anode and the negative side coupled to the metal pendant portions to be protected from corrosion. The latter thus functions as the cathode with respect to the anode. By maintaining the anode at an appropriate potential, current is supplied to the cathode which maintains a protective polarization thereon which essentially prevents corrosion. The particular potential at which the anode is maintained is significant for optimum operation. Where the pendant unit is formed of aluminum, the protected metal member should be maintained at a negative potential of approximately 940 millivolts with respect to a silver-silver chloride reference electrode. In practical systems, a reference electrode is also mounted below the water line and coupled into a controller to maintain maximum effectiveness. To maintain this precise potential, the automatic controller varies the current impressed on the anode. The controller is generally a solid state regulating circuit employing a reference electrode such as a silver base coated with a silver chloride. Variations of the reference potential with respect to the metal member establishes a continuous signal to the controller to vary the driving potential of the anode current until the submerged metal pendant unit is at the desired polarization potential. Thereafter, the controller functions to maintain such an optimum polarization level. Such systems are well-known and are often employed in small, recreational type boats where they are subject to relatively severe physical conditions of bouncing and jarring. As a result, disruption of the circuit connection and the system may occur. Generally, the operation of the system may only be detected by noticing the unwarranted corrosion.

Although galvanometer type systems have been employed in the laboratory to monitor the operation of cathodic protection systems, such systems are completely unacceptable from a practical standpoint for use in marine propulsion devices. Such systems employ highly delicate instruments which cannot readily withstand the physical conditions encountered in marine propulsion units particularly small, recreational boats and they are also subject to corrosion. Further, galvanometer units are relatively expensive and would not, therefore, find wide acceptability. Consequently, the boating industry has relied on visual indications after the fact or special surveys using laboratory type instruments.

SUMMARY OF THE INVENTION

The present invention is particularly directed to a simple, rugged and reliable monitoring unit which can be readily applied to a cathodic protection system such as encountered in marine devices for prupulsion of small recreational type boats and the like. Generally, in accordance with the present invention a generally low voltage and low current indicating device is selectively connected into the cathodic protection circuit via a switch means which directs a change in the circuit operation and produces a detectible output in the event of a properly functioning system. Generally, the switch will be interconnected to the reference electrode and/or anode element of the cathodic protection system to provide selective driving of the indicator as a result of a forced change in the anodic current flow and which forced change is indicative of the functioning of the system. The impressed current cathodic protection system includes the usual anode and reference electrode mounted below the water line of the propulsion unit and selectively connected to a controller. The switch means selectively connects the indicating means such as a light emitting diode (LED) lamp into the cathodic protection system. In accordance with a highly practical system, the switch means is connected in the circuit of the anode and the indicating means. In the normal running position, the switch connects the anode to a regulated power supply of the controller. In the test position, the switch means disconnects the anode and connected the indicating means to the controller. This removes current from the protected marine element and the reference electrode responds with a demand for maximum power and current. As a result, the output of the controller increases if the reference electrode and controller are functioning properly and supplies a relatively heavy current to the indicating means which, in the case of an LED lamp, will be brilliantly illuminated. If the controller is not functioning the lamp will not be illuminated. This has been found to provide a very simple and reliable means for continuously monitoring and checking the condition of a solid state controller. In a practical system, the anode power supply of the controller includes a driving transistor connected between a control transistor and the D.C. supply. The conductivity of the driving transistor is controlled by a control transistor connected in its input circuit. The control transistor, in turn, is connected to the output of a two-input solid state comparator having a preset reference potential as one input and the reference potential electrode connected as the second input. The output of the comparator thereby provides a continuous monitoring to maintain the reference electrode at a preset potential by varying the conductivity of the control transistor which, in turn, varies the conductivity of the anode driver or power transistor. The switch means includes a primary running position connecting the power transistor in series to the anode and a second alternate test position connecting the power transistor in series with the indicating device such as an LED lamp in series with a current dropping resistor.

In an alternate and also practical system, the switch means is connected in a circuit of the reference electrode and normally connects the reference electrode into the circuit of the controller. In the alternate or test position, the reference electrode is disconnected and the LED lamp is connected in circuit in parallel with the anode to cathode circuit. This results in a forced overcharging of the submerged metal marine element with an increased polarization potential thereof. Upon release of the switch and return of the switch to the reference potential, this special controller will reflect the overcharged condition such as by charging of an internal storage means such as a capacitor to provide internal latching which prevents producing of a significant anodic voltage until such condition resets. The retention of the overcharge by a capacitor will, generally, be for a relatively short period such as ten seconds. However, if the switch if again actuated to the test position within such period, the internal latching will prevent the anode supply from rising to supply a high current. Consequently, the LED lamp will remain dim until such time as the controller automatically resets, after the capacitor discharges, and will then burn brightly. Thus, by timed, sequential operation of the switch, the operator can readily determine whether or not the elements including the reference electrode, the anode and/or the controller are operating properly.

The systems based on the teaching of the present invention can employ rugged indicating elements such as a light emitting diode lamp or any other suitable low voltage and current indicator in combination with a simple switch for selective connection into the circuit of a standard controller. The monitor apparatus is thus readily adapted to the severe physical and environmental conditions encountered in small recreational boating and the like. Further, the components employed are essentially standard mass produced components which are relatively inexpensive. As a result, a small, compact and inexpensive unit can be produced which readily is adapted to the boating industry including small, recreational type boats.

BRIEF DESCRIPTION OF THE DRAWING

The drawing furnished herewith illustrates the best mode presently contemplated by the inventor for carrying out the subject invention, and clearly discloses the above advantages and features as well as others which will be readily understood from the subsequent description of the illustrated embodiments.

In the drawing.

DESCRIPTION OF ILLUSTRATED EMBODIMENTS

Figure 1:
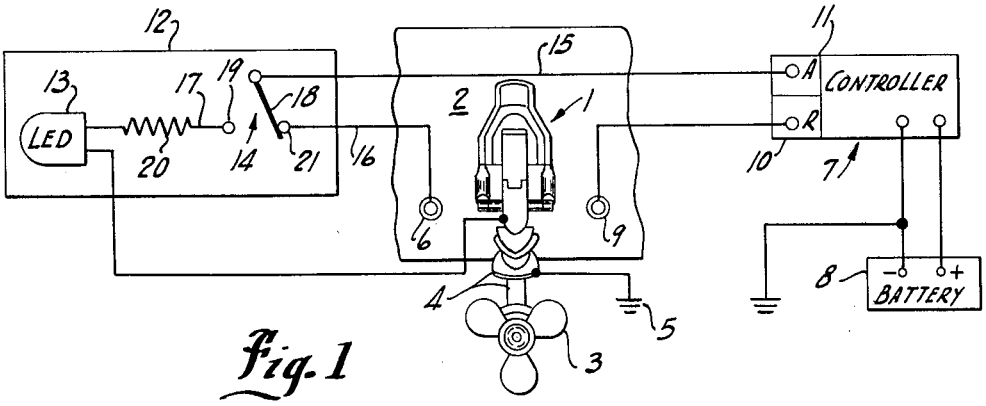
FIG. 1 is a diagrammatic illustration of a marine propulsion pendant unit adapted for propulsion of small boats with a cathodic protection system and a monitoring apparatus constructed in accordance with the present invention.

Referring to the drawing and particularly to FIG. 1, the lower pendant unit 1 of a marine propulsion drive is diagrammatically illustrated mounted to a boat transom 2, of which a fragmentary portion is illustrated. Generally, the pendant unit 1 will include and support a propeller 3 which is coupled to a suitable internal combustion engine for effecting propulsion of a small boat through the water or over a body of water. Thus, the pendant unit 1 may form the lower end of the well-known outboard motor or, as illustrated, may be a part of a stern drive unit connected to an internal combustion engine, not shown, mounted within the boat. In either event, the pendant lower unit 1 includes an outer housing 4 which is formed of aluminum and/or other metals which form a common ground for the electrical system as diagrammatically illustrated by ground line 5. Aluminum lower units and the like are highly subject to corrosion particularly in salt water environments. Generally, in accordance with conventional practice, an anode 6 may be secured to the boat transom 2 in electrically insulated relationship to the transom 2 and to the pendant lower unit 1. The anode 6 is connected to a current regulator or controller 7 having a direct current input or supply connection means shown connected to a suitable direct current supply such as the conventional twelve volt battery 8 employed in recreational boating. Further, a reference electrode 9 is mounted to the transom 2 in spaced relation to the anode 6 and to the lower pendant unit 1 and has an input connected to the controller 7 to provide a signal indicative of the polarization of the lower pendant unit 1. The controller 7 generally includes a suitable reference potential responsive comparator unit 10 driving an adjustable current circuit 11, the output of which supplies current to the anode 6. Thus, an automatically controlled corrosion prevention system is formed which will protect the underwater metal unit 1 from the usual effects of corrosion as long as the system is operating properly. The present invention is particularly directed to a monitoring instrument or unit 12 to permit selective checking on the operation of the cathodic protection system. Generally, the motor unit 12 includes an indicating device 13 illustrated as a light emitting diode. A switch means 14 is provided for selectively connecting of the light emitting diode 13 into the cathodic protection system and for making a change in the system operation to check on the proper functioning of the protective system. In the illustrated embodiments of FIGS. 1 and 2, switch means 14 is shown connected between a main anode lead supply 15 from the current adjustable circuit 11 of the controller 7. It selectively connects the supply lead 15 to an anode lead 16 and to an indicator lead 17 such that the output of the controller 7 is selectively supplied to the anode or to the indicating circuit 12. Under normal operations, the switch means 14 maintains supply of current to the anode 6 with the level being automatically controlled by the relative potential of the protected low pendant unit 1 in relationship to the reference electrode 9. When the switch means 14 is actuated, the anode current is removed and the negative potential of unit 1 decreases rapidly with respect to the reference electrode 9. The controller 7 responds to produce a high or maximum current output condition. The controller should thus provide a relatively large current to the circuit of monitor unit 12 and the light emitting diode 13 should produce a high level of illumination. If, in fact, the light emitting diode 13 does not burn brightly, the operator is immediately given an indication that there is a fault in the cathodic protection system, and further refined checks may be made on the individual components to locate the precise failure point. Thus, by this simple momentary actuation of the switch means 14 the operator can determine the operability of the cathodic protection system.

Figure 2:
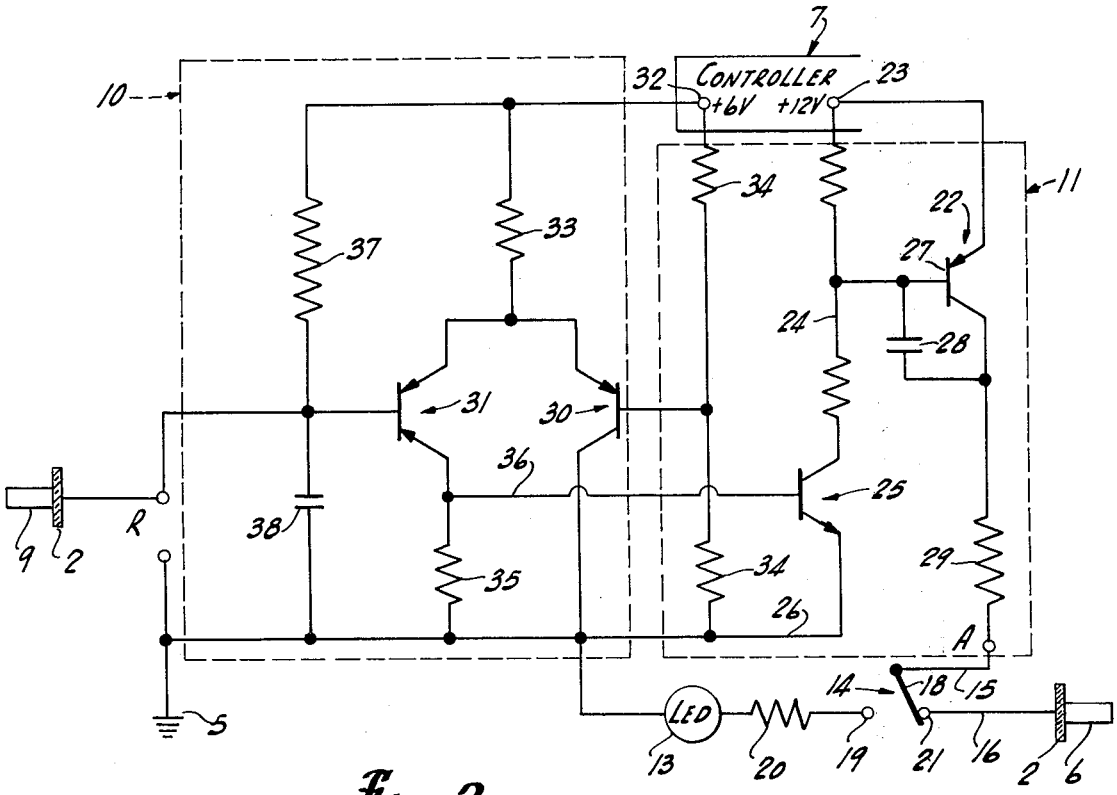
FIG. 2 is a schematic circuit diagram of the controller incorporating the monitoring apparatus of the present invention shown in FIG. 1.

Referring particuarly to FIG. 2, a preferred schematic circuit for the driving of the cathodic protection system is shown. The switch means 14 is illustrated as a conventional single pole double-throw switch having a common pole 18 connected to the current adjusting circuit 11 and having a test contact 19 connected in series with a protective resistor 20 to the light emitting diode 13, the opposite side of which is connected to ground and thus to the same potential as the pendant unit 1. An anode contact 21 is selectively engaged by the common pole 18 to provide power to the anode lead 16 and thus to anode 6.

The current adjusting circuit 11 includes a power transistor 22 which, in the illustrated embodiment of the invention, is shown as the well-known PNP type unit. The emitter is connected directly to the twelve volt supply point or terminal 23 of the controller. An input resistor branch 24 is also connected to the twelve volt terminal 23 and to ground in series with a control transistor 25 to common ground lead 26. The resistive input branch 24 has an intermediate tap point connected to the base 27 of the power transistor 22 such that the conductivity of the control transistor 25 controls the conductivity of the driver or power transistor 22.

In the illustrated embodiment of the invention, a protective capacitor 28 is connected between the base and the output collector of the driver transistor 22 and a series collector resistor 29 is connected to the common contact 18 of the switch means 14.

The control transistor 25 is an NPN transistor having its emitter connected to ground and its collector connected in series with the resistive branch to the twelve volt supply and to the base of the driver transistor 22. The base of transistor 25, in turn, is connected to the comparator 10, the output of which is directly controlled by the potential of the reference electrode 9 as follows.

The illustrated comparator 10 is a solid state unit including a preset transistor 30 and a reference electrode transistor 31 connected in parallel relationship to a six volt supply terminal 32 of the controller 7. The transistors 30 and 31 are similar PNP transistors having their emitters interconnected to each other and in series with a common emitter resistor 33 to 6 volt terminal 32. The collector of the preset transistor 30 is connected directly to the common ground lead 26 and its base is connected to the junction of a pair of series-connected reference resistors 34. The resistors 34 are connected between the six volt terminal 32 and ground lead 26 to maintain a predetermined turn-on bias on the transistor 30. The emitter is thereby positively held at a predetermined reference potential and simultaneously clamps the emitter of the reference electrode transistor 31 at a corresponding potential.

The reference electrode transistor 31 has its collector connected to ground lead 26 in series with a collector resistor 35 and to a control lead 36 connected to the base of the control transistor 25. The conductivity of the reference transistor 31 directly conrols the turn-on potential applied to the conrol transistor 25 which in turn controls the conductivity of the driver transistor 22.

The base of the reference electrode transistor 31 is connected directly to the reference electrode 9 and is also connected to the positive voltage supply terminal 32 in series with a relatively high value resistor 37, for example, a resistor of the order of 6.2 megohms. The base of transistor 31 is further connected directly to ground lead 26 by a transient by-pass capacitor 38.

Under normal operating conditions, the potential of the reference electrode 9 reflects the potential of the pendant unit 1. When the electorde is at a preset potential, such as a −940 millivolts, the driver transistor 22 is driven to provide current sufficient to maintain such potential. If the reference potential varies from such level, the base drive of the transistor 31 varies and its output changes proportionately to correspondingly vary the conductivity of the control transistor 25 and, in turn, the conductivity of the driver transistor 22 to thereby increase or decrease the anodic current until the reference potential as reflected at electrode 9 is returned to the desired level. Thus, the negative potential on the base tends to oppose the turn-on voltage applied by the controller with the level of opposition directly related to the level of the polarization charge. As the switch means 14 is actuated to the test position, the current level should be such as to illuminate the light emitting diode 13. Thus, with the switch activated, the current to the drive unit 1 from the anode 6 stops. As a result the potential of the reference electrode 9 drops and demands full output from the controller. As a result, the diode 13 will burn brightly.

In the normal operation of the circuit, the capacitor 28 functions as a by-pass or decoupling element to remove undesired high frequency transient signals such as, for example, associated with a marine radio. The capacitor 38 in the base circuit of the transistor 31 serves to dampen the response of the amplifying circuitry and provides for a delayed regulatory action in response to step input changes.

If the circuit of reference electrode 9 is disconnected or otherwise does not function properly, the negative potential is removed and the transistor 31 is driven off as a result of the loss of the opposing voltage and the raising of the base potential of the reference transistor 31 through the parallel resistor 37. This will drive the control transistor 25 off which, in turn, will drive transistor 22 off.

When the switch means 14 is now actuated the transistor 22 is cut-off, and the light emitter diode 13 will not be energized. As a result of the absence of light, the operation can readily detect that a fault condition exists. Although this may not provide a direct indication of the source of the fault and primarily monitors the effect of the reference potential circuitry, it provides an extremely simple, reliable and inexpensive monitor which produces a practical method of monitoring a cathodic protection system.

Figure 3:
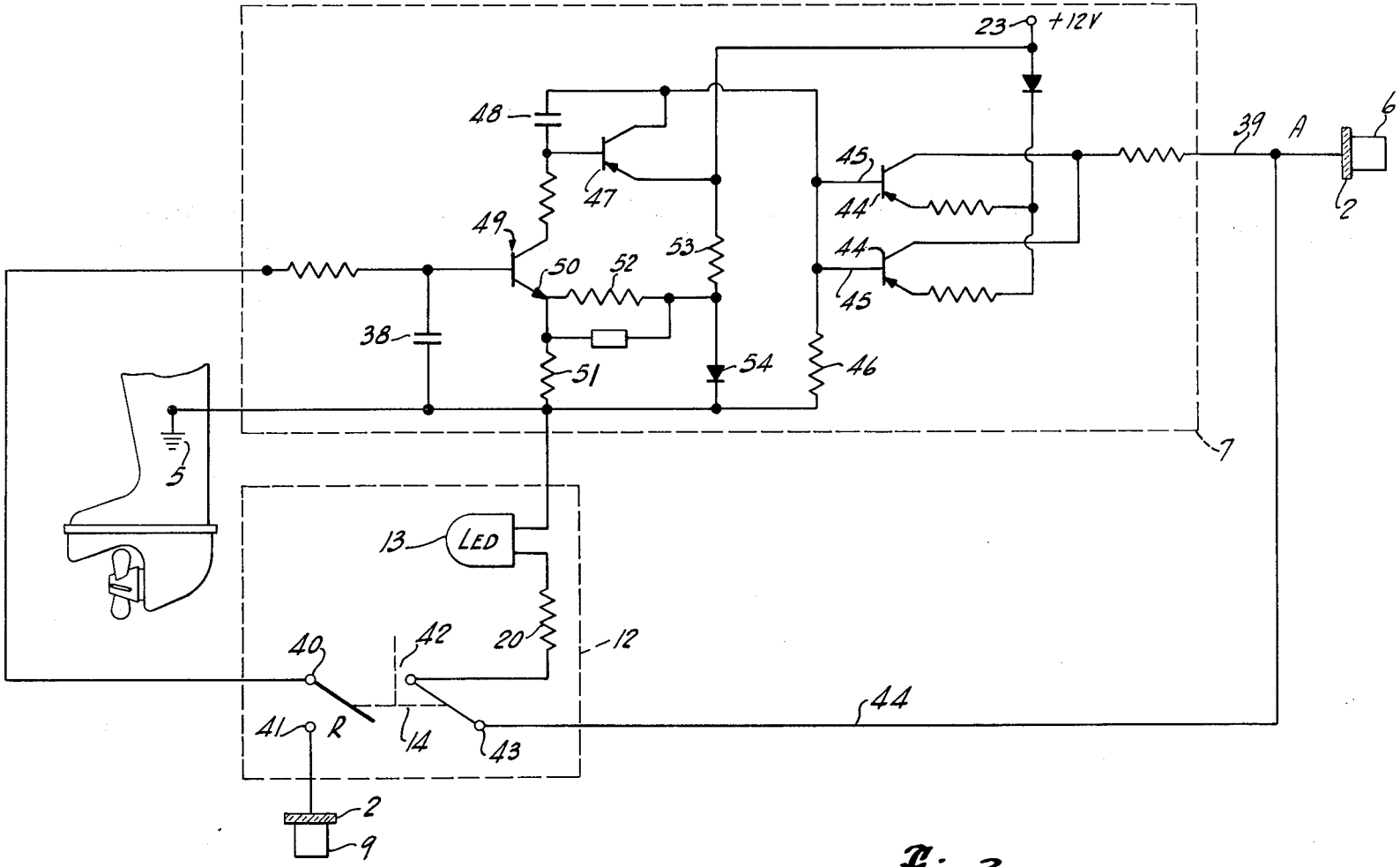
FIG. 3 is a schematic illustration of an alternate construction in accordance with the teaching of the present invention.

FIG. 3 illustrates a somewhat more sophisticated system for detecting the actual operation of the cathodic protection system and one which also may be employed with small recreational boating and the like. Referring particularly to FIG. 3, the illustrated cathodic protection system is generally similar to the first embodiment with an alternate controller circuit shown and corresponding elements are similarly numbered. In FIG. 3, the anode 6 is connected directly to the anode supply terminal via a lead 39. Further in the embodiment of FIG. 3, the switch means 14 is connected as a double-pole, double-throw switching means having a first set of contacts 40–41 connected between the reference electrode 9 and the reference voltage terminal R, as shown in full line illustration. This provides for the normal circuit operation with reference electrode 9 connected to the reference input terminal.

In the alternate position, the switch means 14 includes a set of contacts 42–43 one of which is connected via a coupling lead 44 to the anode lead 39 and thus to the anodic power supply terminal A. The opposite side of the test contacts 42–43 is connected in series with the resistor 20 to the light emitting diode 13 and to the pendant unit 1 as the cathode.

The embodiment of FIG. 3 is shown with an alternate controller circuit for purposes of illustrating the scope of the invention. In FIG. 3, a power transistor 44 connects the anode 6 to the positive supply input terminal. The base 45 of transistor 44 is connected to ground in series with resistor 46 and the emitter is connected to the twelve volt supply terminal 23. The transistor 44 is thus normally biased to conduct. A control transistor 47 is connected between the base 45 and the terminal 23 with a stabilizing capacitor 48 connected across the base-to-collector junction of transistor 47. The potential at the base 45 of the power transistor 44 is established by the control transistor 47 which is varied by the potential of the reference electrode 9 as follows. A reference transistor 49 connects the base of the control transistor 48 to ground 5. The emitter 50 of transistor 49 is connected to a junction of a series of voltage dividing resistors 51, 52 and 53 connected between the twelve volt terminal 23 and ground 5 to provide a selected bias on the emitter. A diode 54 is connected across the resistors 51 and 52 to ground 5. The base of the reference transistor 49 is connected to the reference electrode 9 and its conductivity is directly controller by the potential of the reference electrode 9. The conductivity of the control transistor 47 is thus controlled by the reference transistor to vary the base potential of the power transistor in accordance with the reference electrode potential 9.

The switch means 14 is any suitable switch structure, preferably a push-button type switch. A first actuation of the switch 14 opens the reference electrode circuit to the cathodic protection controller 7. When the reference electrode 9 is disconnected from the reference transistor 49, control transistor 47 turns off and the potential of the base 45 of the power transistor 44 drops and the transistor 44 is driven fully on to provide maximum polarization current. The alternate controller 7 of FIG. 3 is then activated to produce a maximum voltage on the anode 6 and such maximum polarization current, and also provides current in parallel therewith to the test contacts 42–43 of the switch means 14, the resistor 20 and the light emitting diode 13 to the pendant unit 1. As a result there is an excessive current flow into the cathode interface resulting in an increase level of polarization produced by a normal cathodic protection circuit connection. When the switch 14 is released the lamp 13 is, of course, extinguished. The cathode or the pendant unit 1 will remain in the overpolarized condition for a relatively short period of time. Thus, the dissipation thereof is a time function similar to the discharging of a capacitor. In a practical marine propulsion application, the effect of the overcharge will exist for approximately ten seconds. The reference electrode 9 therefore activates the controller 7 to remove the anodic power or voltage or at least reduce it to a minimum as a result of the high overpolarization. More particularly, the excess polarization is reflected within the controller 7 by rapidly charging of the capacitor 38 within the controller such that upon the reset of switch 14, which discharges with the reference electrode connection over a corresponding time period. As a result, if after the initial closing and opening of the switch contacts 42–43, the switch 14 is again promptly activated to close the test contacts 42–43, the excess cathode charge reflection within the controller still exists. Consequently, even though the reference electrode 9 has been again disconnected and the controller 7 should normally provide a demand for maximum anodic voltage, the internal disable system is such that the controller 7 will not respond. Consequently, until such time as the controller 7 is reset, the output is minimal and the light emitting diode 13 of monitor unit 12 will be furnished with minimal current resulting in very dim illumination at most. When the circuit is reset, however, the reference electrode 9 again activates the controller 7 to provide excessive voltage conditions in the same manner as the first switch closing. Consequently, the light emitting diode 13 will burn brightly.

Thus, the successive actuation of switch 14 in a proper sequence, which can be easily executed with a minimum skill, produces an accurate indication of the condition of the anode circuit, the reference circuit and the controller.

The present invention thus provides a simple, rugged and inexpensive monitor unit which can be conveniently produced and applied to marine propulsion cathodic protection systems.

Various modes of carrying out the invention are contemplated as being within the scope of the following claims, particularly pointing out and distinctly claiming the subject matter which is regarded as the invention.

We claim:

1. In a cathodic protective apparatus for a submergible metal unit subject to corrosion including a current supply means for providing a cathodic protection current, a powered submergible anode means and a submergible reference electrode means connected in a cathodic protection circuit to maintain the potential of the metal unit at a selected level, an indicating means, test means coupled to said cathodic protection circuit and including current control means connected to operably open the circuit to one of the anode means and reference electrode means and producing a change in the cathodic protection current from said supply means related to the proper cathodic protection functioning, said control means further connecting said indicating means to said current supply means to monitor said change in the cathodic protection current.

2. In the cathodic protection system of claim 1 including a switch means having a first position connecting said current supply means to said metal unit and said anode in said cathodic protection circuit and creating a variable cathodic protection current flow to said metal unit and having a second position connecting said indicating means in said cathodic protection circuit and energizing said indicating means.

3. In the cathodic protection apparatus of claim 1 wherein said indicating means includes a light emitting diode.

4. The cathodic protection apparatus of claim 1 wherein said indicating means includes a light emitting diode and said test means includes a switch connecting said power supply to said anode and alternatively to said indicating means.

5. The apparatus of claim 1 wherein an amplifier connects said power supply means to said anode, said reference electrode means producing a variable voltage relative to the potential of the metal unit and connected to control the output of the amplifier to maintain the potential of the metal unit at a selected level, said test means includes a switch connected between the amplifier and the anode and having a test position operatively opening the anode circuit and connecting the indicating means to the amplifier.

6. In a cathodic protective apparatus for a submergible metal unit subject to corrosion including a current supply means for providing a cathodic protection current, a powered submergible anode means and a submergible reference electrode means connected in a cathodic protection circuit to said current supply means to maintain the potential of the metal unit at a selected level, test means coupled to said cathodic protection circuit and including current control means selectively producing a change in the cathodic protection current related to the proper cathodic protection functioning, an indicating means connected to said cathodic protection circuit monitors said change, a supply means, said test means is a switch means having common contact means connected to the supply means and operably engaging a first contact means connected to the anode means and a second contact means connected to the indicating means, said supply means including a controlled amplifier connected to said common contact means and having a control input, a reference potential monitoring means establishing an output in accordance with the level of the reference potential, said monitoring means responding to disconnection of said supply means from said anode to increase the output of the amplifier, and said monitoring means being connected to deactivate said amplifier in response to a reference potential below a selected minimum level.

7. The cathodic protection apparatus of claim 6 wherein said indicating means includes a low voltage and current element.

8. The cathodic protection apparatus of claim 6 wherein said indicating means includes a low voltage and current light emitting diode in series with a current limiting resistor.

9. The cathodic protection system of claim 6 wherein said amplifier is a transistor having an emitter-to-collector circuit connected in series to said common contact means and a base, a base-return control transistor connecting said base to said supply means, said monitoring means including a comparator including first and second parallel connected transistors defining first and second inputs, said first input being connected to a control reference supply and said second input being connected to said reference potential electrode means, and said base-return control transistor having an input connected to the collector of the second transistor of said comparator.

10. In a cathodic protective apparatus for a submergible metal unit subject to corrosion including a current supply means for providing a cathodic protection current, a powered submergible anode means and a submergible reference electrode means connected in a cathodic protection circuit to said current supply means to maintain the potential of the metal unit at a selected level, test means coupled to said cathodic protection circuit and including current control means selectively producing a change in the cathodic protection current related to the proper cathodic protection functioning, an indicating means connected to said cathodic protection circuit monitors said change, a controller having a direct current voltage terminal means connected to said anode means and said reference electrode means, said test means is connected to said metal unit and selectively establishes a path through said test means in parallel to said cathodic protective current path to overcharge said metal unit, said controller includes overcharge sensitive means to reduce the output of the controller for a predetermined period after reset of the test means.

11. The apparatus of claim 10 wherein said test means includes a switch means having a first position connecting said controller to said reference electrode means and disconnecting said indicating means and second position disconnecting said reference electrode means and connecting said indicating means to said anode and to said submergible metal unit whereby successive operation of said switch means produces an immediate energization of said indicating means and a delay energization of said indicating means in response to a proper functioning cathodic protection circuit.

12. In the cathodic protection apparatus of claim 10 wherein said indicating means is connected in series in said path and includes a light emitting diode and a series current limiting resistor means.

13. The apparatus of claim 10 wherein said overcharge sensitive means includes a capacitor and charged to the level of the polarization of the reference electrode means and discharging therethrough to reduce the output of the controller.

14. In the apparatus of claim 13 wherein said test means includes a switch means having a first contact means connecting said reference electrode to said controller and second contact means connecting said anode to said indicating means, said indicating means being connected to said metal unit and producing said path parallel to said cathodic protective current path to overcharge said metal unit.

15. In the cathodic protection system of claim 6 having a power supply means and wherein said test means includes a switch means which is a single pole, two position switch having a first common contact means connected to the controller and having a second contact means connected to the anode and a third contact means connected to the indicating means to establish said path, said controller including a controlled power amplifier connected between the power supply means and the anode means and having a control input, a reference potential monitoring means including an input amplifier establishing an output in accordance with the level of the reference potential and varying the output of said power amplifier in response to the reference potential, said input amplifier having an input means coupled to said reference electrode means and having a damping capacitor means connected to the input means to delay the response of the amplifier to a step change at the reference electrode means.

16. The cathodic protection system of claim 15 wherein said power amplifier is a transistor having an emitter-to-collector circuit connected means in series to said common contact and having a base, a base-return transistor connecting said base to said supply means, said monitoring means including a comparator including a preset transistor in parallel with said input transistor, said preset transistor being connected control reference supply.

* * * * *

UNITED STATES PATENT AND TRADEMARK OFFICE

CERTIFICATE OF CORRECTION

PATENT NO. : 3,953,742
DATED : April 27, 1976
INVENTOR(S) : EDWARD P. ANDERSON and MARK HARRIS It is certified that error appears in the above-identified patent and that said Letters Patent are hereby corrected as shown below:

| | | | | |
|---|---|---|---|---|
| Column CLAIM 13 | 10, | Line | 34, | after "capacitor" cancel "and"; |
| Column CLAIM 16 | 10, | Line | 68 | after "connected" cancel " means"; |
| Column CLAIM 16 | 11, | Line | 1, | after "contact" insert --- means ---; |
| Column CLAIM 16 | 12, | Line | 1, | after "connected" insert --- to a ---. |

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*